US007644610B2

(12) United States Patent
Meister

(10) Patent No.: US 7,644,610 B2
(45) Date of Patent: Jan. 12, 2010

(54) AUTOMATED FORMATION FLUID CLEAN-UP TO SAMPLING SWITCHOVER

(75) Inventor: Matthias Meister, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 109 days.

(21) Appl. No.: 11/844,506

(22) Filed: Aug. 24, 2007

(65) Prior Publication Data

US 2009/0049904 A1 Feb. 26, 2009

(51) Int. Cl.
*E21B 49/08* (2006.01)

(52) U.S. Cl. ..... 73/152.23; 702/6

(58) Field of Classification Search ..... 73/152.23
See application file for complete search history.

(56) References Cited

U.S. PATENT DOCUMENTS

| | | | | |
|---|---|---|---|---|
| 3,490,480 | A | 1/1970 | Parsons | |
| 4,032,781 | A | 6/1977 | Arnold | |
| 4,809,790 | A | 3/1989 | Manchak, Jr. | |
| 4,860,581 | A | 8/1989 | Zimmerman et al. | |
| 5,803,186 | A | 9/1998 | Berger et al. | |
| 6,047,239 | A | 4/2000 | Berger et al. | |
| 6,157,893 | A | 12/2000 | Berger et al. | |
| 6,268,911 | B1 | 7/2001 | Tubel et al. | |
| 6,558,901 | B1 * | 5/2003 | Catanzariti et al. | 435/6 |
| 6,581,455 | B1 | 6/2003 | Berger et al. | |
| 6,659,177 | B2 | 12/2003 | Bolze et al. | |
| 6,668,924 | B2 | 12/2003 | Bolze et al. | |
| 6,688,390 | B2 | 2/2004 | Bolze et al. | |
| 6,799,117 | B1 | 9/2004 | Proett et al. | |
| 7,204,309 | B2 | 4/2007 | Segura et al. | |
| 7,398,159 | B2 * | 7/2008 | Venkataramanan et al. | 702/11 |
| 2005/0166961 | A1 | 8/2005 | Means et al. | |
| 2006/0155472 | A1 * | 7/2006 | Venkataramanan et al. | 702/10 |
| 2008/0156088 | A1 * | 7/2008 | Hsu et al. | 73/152.23 |

OTHER PUBLICATIONS

International Search Report for International Application PCT/US2008/074020. Mailed Nov. 6, 2008.
Written Opinion of the International Searching Authority for International Application PCT/US2008/074020. Mailed Nov. 6, 2008.

* cited by examiner

*Primary Examiner*—Hezron Williams
*Assistant Examiner*—Rodney T Frank
(74) *Attorney, Agent, or Firm*—Cantor Colburn LLP

(57) ABSTRACT

Apparatus and method for downhole formation fluid sampling include conveying a carrier into a well borehole that traverses a subterranean formation of interest, the carrier having a port and placing the port in fluid communication with the subterranean formation of interest. The method includes urging a fluid into the port using a fluid control device, the fluid containing a formation fluid and a contaminant, generating a first signal indicative of a first fluid characteristic of the fluid using a first test device in communication with the fluid, and generating a second signal indicative of a second fluid characteristic of the fluid using a second test device in communication with the fluid. The first signal and the second signal are processed using a processing device to estimate a level of contamination in the fluid, and a control signal is generated when the estimated level of contamination meets a predetermined value, the control signal actuating the fluid control device to direct fluid having a level of contamination at about or below the predetermined value to a fluid sampling chamber carried by the carrier.

32 Claims, 5 Drawing Sheets

AUTOMATED FORMATION FLUID CLEAN-UP TO SAMPLING SWITCHOVER

BACKGROUND

1. Technical Field

The present disclosure generally relates to well bore tools and in particular to apparatus and methods for downhole fluid sampling.

2. Background Information

In the oil and gas industry, formation testing tools have been used for monitoring formation pressures along a well borehole, obtaining formation fluid samples from the borehole and predicting performance of reservoirs around the borehole. Such formation testing tools typically contain an elongated body having an elastomeric packer and/or pad that is sealingly urged against a zone of interest in the borehole to collect formation fluid samples in fluid receiving chambers placed in the tool.

Downhole multi-tester instruments have been developed with extensible sampling probes for engaging the borehole wall at the formation of interest for withdrawing fluid samples from the formation and for measuring pressure. In downhole instruments of this nature an internal pump or piston may be used after engaging the borehole wall to reduce pressure at the instrument formation interface causing fluid to flow from the formation into the instrument.

Formation fluid sampling during drilling operations requires a clean-up process for removing contaminants, such as borehole fluid containing drilling fluid and formation fluid, from the fluid entering a sampling tool. Likewise, sampling processes using wireline tools need to remove contaminants from fluid samples. Once the clean-up process is complete, a sampling process may begin where clean formation fluid is transferred to sampling chambers. Traditionally, an application engineer at the well site sends a command to switch over from the clean-up process to the sampling process. The clean-up process is sometimes a timed process whereby the application engineer waits a predetermined length of time and assumes that the fluid stream entering the tool is free of contaminants at the end of the time period for clean-up. Some sampling processes include fluid measurements that are interpreted by an application engineer who then decides when to switch from the clean-up process to the sampling process. Pump rates are typically selected as a fixed rate low enough to maintain pressure above the fluid bubble-point during the draw down.

SUMMARY

The following presents a general summary of several aspects of the disclosure in order to provide a basic understanding of at least some aspects of the disclosure. This summary is not an extensive overview of the disclosure. It is not intended to identify key or critical elements of the disclosure or to delineate the scope of the claims. The following summary merely presents some concepts of the disclosure in a general form as a prelude to the more detailed description that follows.

Disclosed is a downhole fluid sampling apparatus that includes a carrier conveyable into a well borehole that traverses a subterranean formation of interest, the carrier having a port that is placed in fluid communication with the subterranean formation of interest. A fluid control device urges a fluid into the port, the fluid containing a formation fluid and a contaminant. A first test device is in communication with the fluid, the first test device generating a first signal indicative of a first fluid characteristic of the fluid. A second test device is in communication with the fluid, the second test device generating a second signal indicative of a second fluid characteristic of the fluid. A processing device receives the first signal and the second signal, the processing device processing the first signal and the second signal to estimate a level of contamination in the fluid, the processing device generating a control signal when the estimated level of contamination meets a predetermined value, the control signal actuating the fluid control device to direct fluid having a level of contamination at about or below the predetermined value to a fluid sampling chamber carried by the carrier.

In another aspect, a method for downhole fluid sampling includes conveying a carrier into a well borehole that traverses a subterranean formation of interest, the carrier having a port and placing the port in fluid communication with the subterranean formation of interest. The method includes urging a fluid into the port using a fluid control device, the fluid containing a formation fluid and a contaminant, generating a first signal indicative of a first fluid characteristic of the fluid using a first test device in communication with the fluid, and generating a second signal indicative of a second fluid characteristic of the fluid using a second test device in communication with the fluid. The first signal and the second signal are processed using a processing device to estimate a level of contamination in the fluid, and a control signal is generated when the estimated level of contamination meets a predetermined value, the control signal actuating the fluid control device to direct fluid having a level of contamination at about or below the predetermined value to a fluid sampling chamber carried by the carrier.

BRIEF DESCRIPTION OF THE DRAWINGS

For a detailed understanding of the present disclosure, reference should be made to the following detailed description of the several non-limiting embodiments, taken in conjunction with the accompanying drawings, in which like elements have been given like numerals and wherein.

DESCRIPTION OF EXEMPLARY EMBODIMENTS

Figure 1:
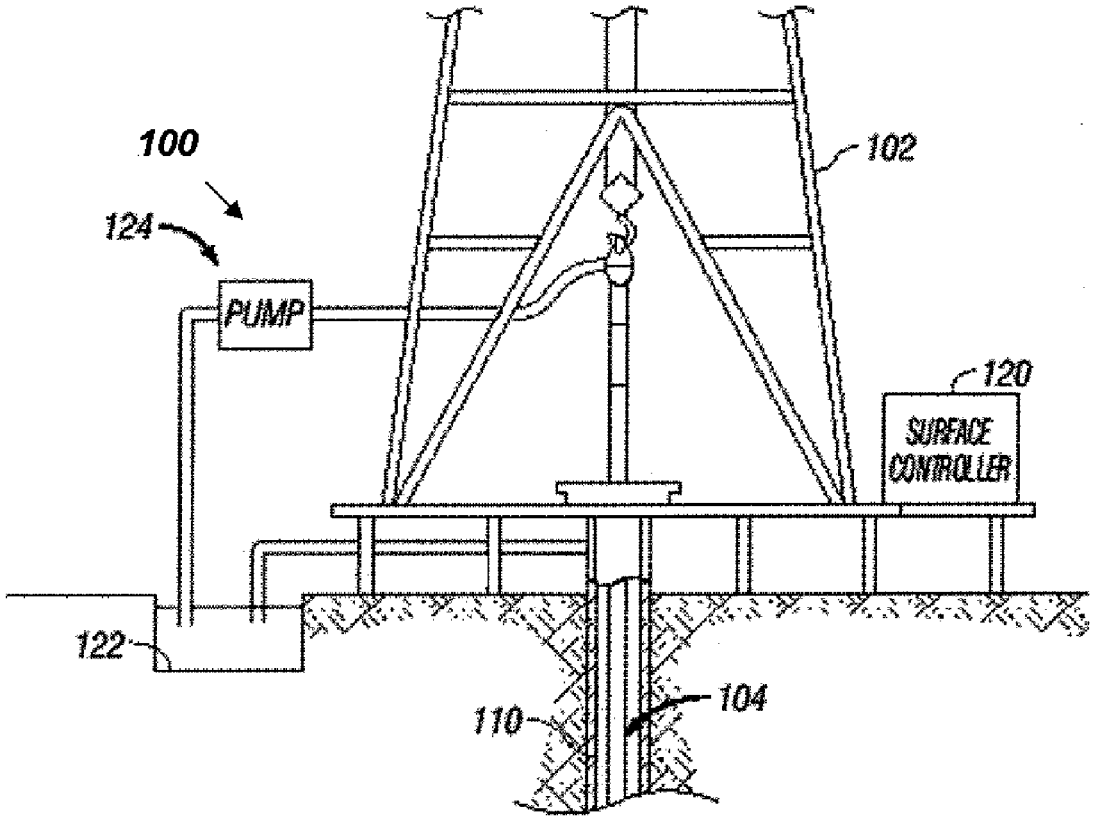
FIG. 1 is an exemplary logging-while drilling system useful for several embodiments of the disclosure.
Figure 1:
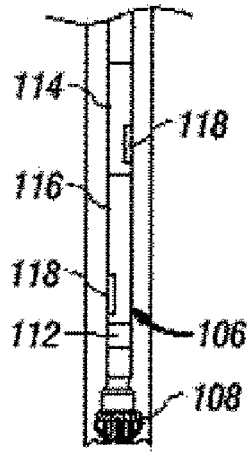

FIG. 1 schematically illustrates a non-limiting example of a drilling system 100 in a measurement-while-drilling (MWD) arrangement according to one embodiment of the disclosure. A derrick 102 supports a drill string 104, which may be a coiled tube or drill pipe. The drill string 104 may carry a bottom hole assembly (BHA) 106 and a drill bit 108 at a distal end of the drill string 104 for drilling a borehole 110 through earth formations.

Drilling operations according to several embodiments may include pumping drilling fluid or "mud" from a mud pit 122, and using a circulation system 124, circulating the mud through an inner bore of the drill string 104. The mud exits the drill string 104 at the drill bit 108 and returns to the surface through an annular space between the drill string 104 and inner wall of the borehole 110. The drilling fluid is designed to provide the hydrostatic pressure that is greater than the formation pressure to avoid blowouts. The pressurized drilling fluid may further be used to drive a drilling motor, provides lubrication to various elements of the drill string and is used for cleaning cuttings from the borehole.

In one non-limiting example, subs 114 and 116 may be positioned as desired along the drill string 104. As shown, a sub 116 may be included as part of the BHA 106. Each sub 114, 116 may include one or more components 118 adapted to provide formation tests while drilling ("FTWD") and/or functions relating to drilling parameters. Sometimes drilling progression and bit rotation may be stopped for certain tests, although these tests are generally considered as while-drilling tests. The subs 114, 116 may be used to obtain parameters of interest relating to the formation, the formation fluid, the drilling fluid, the drilling operations or any desired combination. Characteristics measured to obtain to the desired parameter of interest may include pressure, flow rate, resistivity, dielectric, temperature, optical properties, viscosity, density, chemical composition, pH, salinity, tool azimuth, tool inclination, drill bit rotation, weight on bit, etc. These characteristics may be processed by a processor (not shown) downhole to determine the desired parameter. Signals indicative of the parameter may then be transmitted to the surface via a transmitter in a transceiver 112 used for bi-directional communication with the surface. The transceiver 112 may be located in the BHA 106 or at another location on the drill string 104. These signals may also, or in the alternative, be stored downhole in a data storage device and may also be processed and used downhole for geosteering or for any other suitable downhole purpose. As used herein, the term parameter refers to the result of any useful measurement, calculation, estimation, or the like relating to drilling operations. For example, drilling parameters may include drilling speed, direction, weight on bit (WOB), mud characteristics (e.g. mud density, composition, etc . . . ), torque, inclination and any other parameter relating to drilling. Other examples of parameters are formation parameters including rock type and composition, porosity, fluid composition produced from a formation, pressure, temperature, mobility, water content, gas content, lithology, density, porosity and other aspects of subterranean formations and fluid properties produced from such formations. Obtaining these drilling and formation parameters provides useful information for further drilling operations and helps to determine the viability of a reservoir for producing hydrocarbons.

Many downhole operations include sampling formation fluid for testing. The samples obtained may be tested downhole using instruments carried by wireline, by the drill string, coiled tubing or wired pipe. Formation fluid samples may be brought to the surface for testing on-site or in a laboratory environment.

Figure 2:
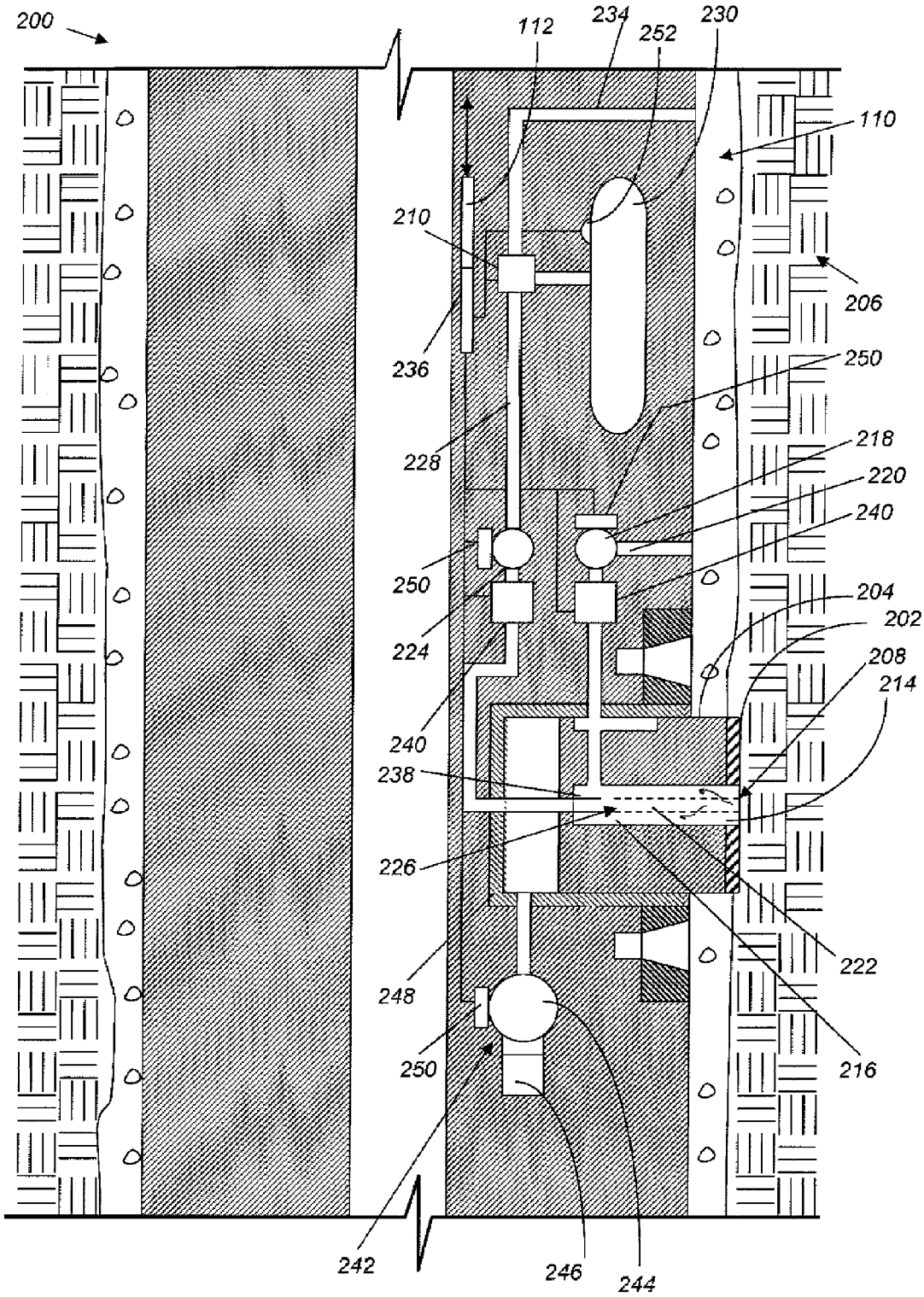
FIG. 2 illustrates a non-limiting example of a down hole fluid sampling tool according to the disclosure.

Referring now to FIGS. 1 and 2, one non-limiting example of a sub 116 component 118 may include a fluid sampling tool 200. In several embodiments, the fluid sampling tool 200 may include a sampling probe 204 having a durable rubber pad 202 at a distal end of the sampling probe 204. The pad 202 may be mechanically pressed against the borehole wall adjacent a formation 206 hard enough to form a hydraulic seal between the wall and probe 204. A probe extension and retraction device 242 may be used to extend and retract the sampling probe 204. Any number of extension and retraction devices 242 may be used and remain within the scope of the disclosure. In the non-limiting example shown in FIG. 2, the extension and retraction device 242 includes a hydraulic pump 244 that pumps hydraulic fluid contained in a reservoir 246 to and from a probe housing 248. The sampling probe 204 is movably disposed in the probe housing 248, such that hydraulic fluid pressure in the housing 248 causes the fluid sampling probe 204 to move in or out with respect to the tool 200.

The pad 202 includes an opening or port 208 leading to a cavity 214 formed by an inner wall 216 of the probe 204. A pump 218 may be used to reduce pressure within the cavity 214 to urge formation fluid into the port 208 and cavity 214. A flow line 220 may be used to convey fluid from the cavity 214 to the borehole annulus 110. In one non-limiting example, a fluid analysis device 240 may be used to determine type and content of fluid flowing in the flow line 220. The fluid analysis device 240 may include any number of testing devices, and is shown schematically here as a single box for simplicity. The fluid analysis device 240 may be located on either side of the pump 218 or the several test devices may be located on both the inlet and outlet of the pump 218 as desired. A more detailed description of the fluid analysis device 240 is provided below with reference to FIG. 3.

Formation fluid may be received into any number of probe configurations. In the non-limiting example of FIG. 2, a sleeve-like member, or simply sleeve, 222 is disposed within the cavity 214 and is in fluid communication with fluid entering the cavity 214. As used herein, the term sleeve means a member having a length, an outer cross-section perimeter and an inner cross-section perimeter creating a volume within the member. In the example of a cylindrical sleeve, the outer cross-section perimeter may be referred to as an outer diameter (OD) and the inner cross-section perimeter may be referred to as an inner diameter (ID). The term sleeve however, includes any useful cross-section shaped member that may not be circular as in the case of a cylinder, but may include shapes including eccentric. Several examples of a probe 204 having a substantially coaxial sleeve 222 are described in U.S. provisional patent application 60/894,720 for "METHOD AND APPARATUS FOR COLLECTING SUBTERRANEAN FORMATION FLUID" filed on Mar. 14, 2007, the entire contents of which are incorporated herein by reference.

A second pump 224 may be used to control fluid pressure within the sleeve 222. A flow path 226 within the sleeve 222 allows fluid to be conveyed from the sleeve 222 flow path 226 through flow lines 228, which may lead to a sampling chamber 230, and optionally to a dump line 234 leading back to the borehole annulus. The dump line 234 may be routed to any suitable location as shown, above the sampling chamber 230 or in-line with the sampling chamber 230. A controllable valve 210 may be used to control fluid flow from the second pump 224 to either the sampling chamber 230 or to the dump line 234. In one non-limiting example, a second fluid analysis device 240 may be used to determine type and content of fluid flowing in the flow line 228. The fluid analysis device 240 may include any number of testing devices as mentioned above. The fluid analysis device 240 may be located on either side of the pump 240 or the several test devices may be located on both the inlet and outlet of the pump 240 as desired.

Each of the pumps 218, 224 may be independently controlled by one or more surface controllers (see 120 FIG. 1), or by one or more downhole controllers 236 as shown and by programmed instructions that are stored in a memory within the controller 236 and executed by a processor in the controller 236. Bi-directional communication between the surface and the tool 200 may be accomplished using a transceiver 112 in communication with the controller 120, 236. As mentioned above with reference to FIG. 1, the transceiver 112 may utilize any number of communication media, including drilling fluid pulse telemetry and wired telemetry. The tool may be disposed on a wired pipe or a wireline tool carrier may be used where a communication cable extends to the surface.

Addressable pump actuators 250 may be coupled to each pump 218, 224 for receiving pump-specific communication from the controller 236. The controller may issue control commands such as on/off commands, pump rate commands and/or pump direction commands to control fluid flow within the tool 200. An addressable pump actuator may be coupled to the probe extension pump 244 so that the controller 236 may be used to control probe extension as well. Any suitable addressable actuator may be used or an addressable circuit may be incorporated into the pumps for receiving pump-specific communication from the controller 120, 236.

Fluid flow in the sampling probe 204 according to several embodiments is controlled by controlling the flow rate in the cavity 214, the flow path 226, or both the cavity 214 and flow path 226 such that direction of fluid flowing in the cavity and the flow path may be controlled with respect to one another as represented by the arrows within the cavity 214 that show fluid flowing between the sleeve 222 and the cavity 214. In some cases, a flow rate may be selected for the cavity area and/or the flow path that urges at least some fluid flow from the flow path 226 to flow to the cavity 214 and on to the cavity pump 218. In other cases, a flow rate may be selected for the cavity area and/or the flow path that urges at least some fluid flow from the cavity 214 to the flow path 226 and on to the sleeve pump 224 for testing and/or storage.

The several exemplary embodiments disclosed herein provide autonomous switchover from a clean-up process to a sampling process using the tool 200. In operation, commands from the controller 236 may initiate the first pump 218 for a fluid clean-up process.

The autonomous switchover may be accomplished using a closed-loop sensor and actuator system. The fluid analysis device 240 takes multiple measurements to estimate several fluid characteristics of the fluid entering the probe 204. These estimates are transmitted as electrical signals to the controller 236 processor and/or to the surface controller 120 processor. In one example, the processor may be used to access information relating to characteristics of drilling fluid and/or borehole fluid, and these characteristics may be used in programs to compare fluid entering the probe to the drilling and/or borehole fluid characteristics. In another example, known formation fluid characteristics are stored in the database and used to compare the characteristics estimated using the fluid analysis device 240. The controller may be programmed with a preset acceptable level of contamination, such as 5% acceptable contamination for example. Once the preset acceptable contamination is achieved, the controller sends an electrical signal to the addressable pump actuators 250 to automatically begin a sample acquisition process. The controller may further command the addressable controllable valve 210 to divert all or part of the fluid flowing into the probe 204 to the sample tank 230. A pressure sensor 252 may be used to monitor fluid pressure in the sample tank 230. A suitable overpressure for maintaining the sampled fluid in single-phase may be programmed into the controller. A signal from the pressure sensor 252 may be conveyed to the controller 236. The controller 236 may then process the received pressure signal and command the pump 224 to stop pumping fluid into the tank 230. Multiple tanks 230 may be used, and second or other tanks may be filled automatically simultaneously with the first tank 230 or after the first tank 230 is filled. The controller may then send a command signal to the addressable pump actuator 250 coupled to the probe extension pump 244 to retract the probe 204.

In the non-limiting example of FIG. 2, the sampling probe 204 is shown mounted on the sub 116, but any suitable mounting location may be used that allows formation fluid communication into the tool 200. For example, a sub member extending from the tool 200 may be used as a mounting location. In one example, the fluid sampling probe 204 may be incorporated into a centralizer. Those skilled in the art will understand that a centralizer is a member, usually metal, extending in a radial direction from the sub 116 and is used to help keep the sub 116 centered within the borehole. Other configurations of downhole tools may use ribs as centralizers or no centralizer at all. In some cases, a backup shoe may be used to provide a counter force to help keep the probe pad 202 pressed against the borehole wall.

The fluid sampling probe 204 may be coupled to the sub 116 in a controllably extendable manner by using an extension device 242 as described above. In other embodiments, dual packers or straddle packers may be used as the sealing element. In another example, the fluid sampling probe 204 may be mounted in a fixed position with an extendable rib or centralizer used to move the pad 202 toward the borehole wall.

The inner sleeve-like member 222 may be of any number of sleeve types to allow fluid communication between the sleeve flow path 226 and cavity 214. In one example, the sleeve may be a solid cylinder-shaped sleeve that extends from a rear section 238 of the fluid sampling probe 204 toward the pad port 208 and terminating in the cavity without extending all the way to the borehole wall. In this manner, fluid communication between the sleeve flow path and cavity is concentrated substantially near the sleeve terminating end within the cavity. In another non-limiting example, the sleeve-like member 222 may include several openings along the length of the sleeve or the front portion of the sleeve 222 to allow fluid communication between the sleeve flow path 226 and the cavity 214 as shown by the arrows extending from the flow path 226 to the cavity 214. In several embodiments that include openings along the sleeve 222, the sleeve 222 may either terminate within the cavity 214 or the sleeve may extend to the borehole wall as shown in FIG. 2.

Figure 3:
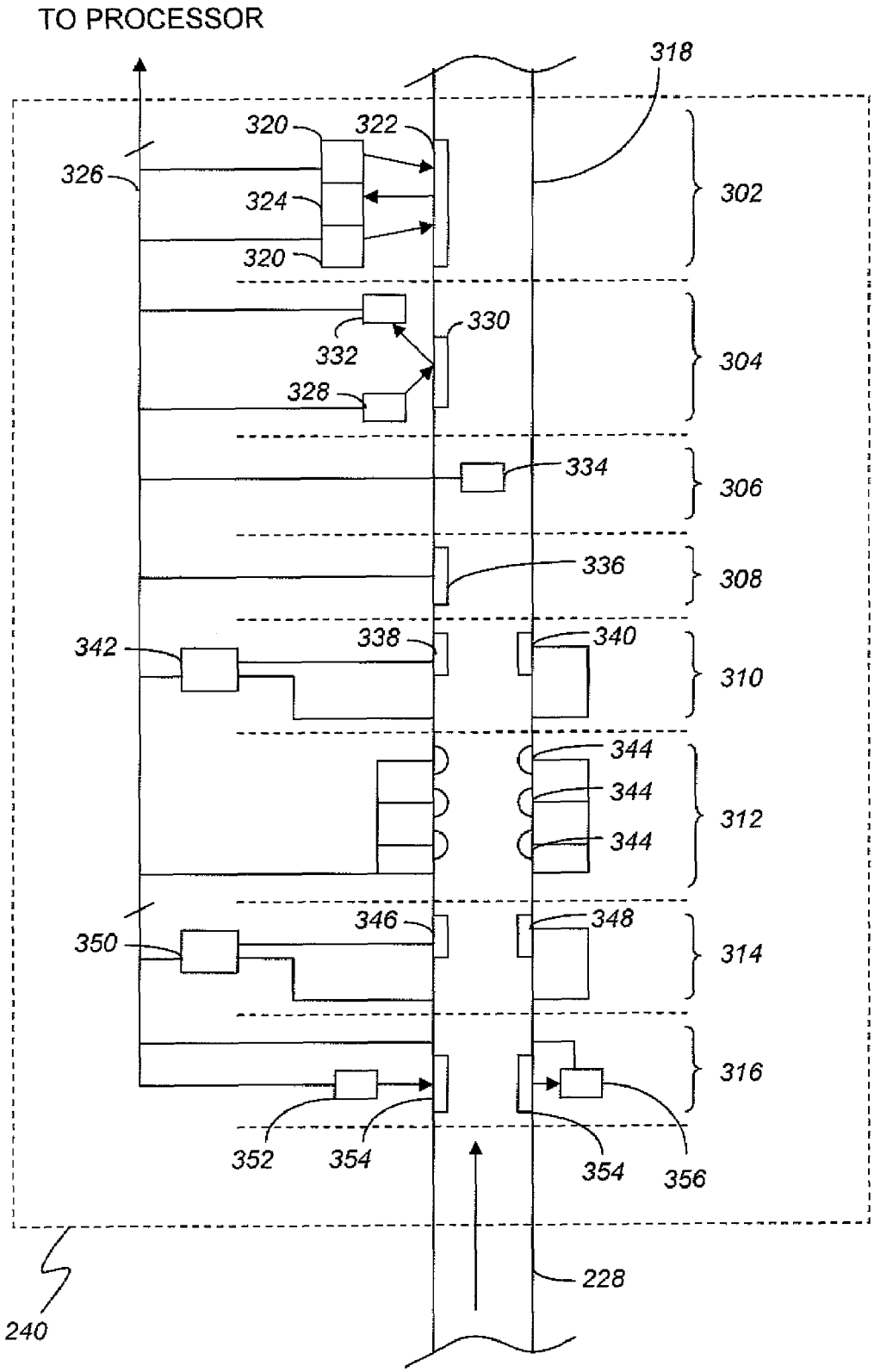
FIG. 3 is a non-limiting example of a downhole fluid analysis device used in several embodiments.

FIG. 3 illustrates a non-limiting example of a fluid analysis device 240 having several fluid test devices 302, 304, 306, 308, 310, 312, 314, 316. The fluid analysis device 240 may include any number of fluid test devices for estimating the several characteristics typical of fluid flowing in the tool 200. Shown here are a fluorescence test device 302, a reflectometer 304, a viscometer 306, pressure and temperature transducers 308, sonic devices 310, resistivity measurement devices 312, capacitance and dielectric constant measurement devices 314, and spectrometers 316.

The fluid analysis device 240 in several embodiments includes a fluid cell 318 that may be a continuous flow path portion of the flow lines 228 (or 220 of FIG. 2) leading to and from the fluid analysis device 240. Each of the fluid test devices 302, 304, 306, 308, 310, 312, 314, 316 is in communication with the fluid cell 318 with each test device being used for estimating a different characteristic of fluid flowing in the fluid cell 318. Any useful characteristic of the fluid flowing in the fluid cell 318 may be estimated. Non-limiting examples are optical characteristics, electrical characteristics and physical characteristics. Depending upon the test devices used, several coupling methods may be used for coupling a particular test device to the fluid cell 318. For example, some test devices may be in fluid contact with fluid in the fluid cell 318, some devices may be in optical communication, some devices may be in acoustic communication, some devices may be in physical contact with fluid in the fluid cell 318, and still others may be in pressure and/or thermal communication with the fluid in the fluid cell 318. The representative example in FIG. 3 shows one possible order of a particular set of test devices. Other combinations of test devices placed in various relative positions may be used to estimate characteristics of the fluid. As noted earlier, the fluid analysis device 240 is not necessarily a set of contiguously placed fluid test devices. The fluid analysis device may be functionally achieved by gathering information from several test devices placed at non-contiguous locations along a drill string and testing fluid entering the drilling tool.

In the non-limiting example of FIG. 3, optical characteristics may be estimated using a downhole fluorescence test device 302 that includes a light source 320 emitting a light toward a window 322 in optical communication with fluid in the fluid cell 318. A photodetector 324 may be used to detect fluorescence emitted by fluid components in the fluid within the fluid cell 318. An output of the fluorescence test device 302 may be conveyed via a data bus 326 to a processor 236 for processing. Other optical characteristics may be estimated using a reflectometer 304 that includes a light source 328 emitting a light toward a window 330 in optical communication with fluid in the fluid cell 318. A photodetector 332 may be used to detect light energy reflected by the fluid within the fluid cell 318. An output of the reflectometer 304 may be conveyed via the data bus 326 to the processor 236 for processing. Other optical energy characteristics may be estimated using a spectrometer 316 to determine spectral wavelength information in the visible range near infrared range or other using other wavelengths for mass spectrometry and gas content. The spectrometer 316 may include a light source 352 emitting light toward a window 354 in the fluid cell 318. A photodetector 356 receives light energy after the emitted light interacts with the fluid in the fluid cell. The energy received at the photodetector provides spectral energy information about the fluid in the fluid call. Optical information may be conveyed to the processor 236 via the data bus 326.

Physical characteristics of the fluid may be estimated using a viscometer 306 that includes a transducer 334 converting fluid viscosity characteristics to information conveyed to the processor 236 via the data bus 326. Other physical characteristics such as pressure, temperature and fluid density may be estimated using pressure, temperature and fluid density transducers 308 that include respective sensing elements 336 for gathering pressure, temperature and fluid density information in electronic form. The gathered information may be conveyed to the processor 236 via the data bus 326. Another physical characteristic relates to acoustic transmittance of the fluid, which may be estimated using sonic devices 310 having associated energy source 338 and receiver 340 and an electronics module 342 for converting the sonic information received to a form for transmitting.

Electrical characteristics may be estimated using resistivity measurement devices 312 that may include several contacts 344 for estimating resistivity of the fluid. Other electrical characteristics of the fluid may be estimated using capacitance and dielectric constant measurement devices 314 having associated contacts 346, 448 and electronics module 350 for determining fluid electrical characteristics. Output signals from the sonic devices 310, the resistivity devices 312, the capacitance/dielectric devices 314 and any other suitable test device may be conveyed to the processor 236 via the data bus 326.

Other devices may be included on the tool 300 without departing from the scope of the disclosure. One or more of the devices depicted in FIG. 3 may include a chemical test device, a fluid compositional analysis device, a gas chromatograph, a pH test device, a salinity test device, a CO2 test device, an H2S test device, a device for determining wax and asphaltene components, a device for determining metal content, (mercury or other metal), and a device for determining acidity of the fluid.

Figure 4:
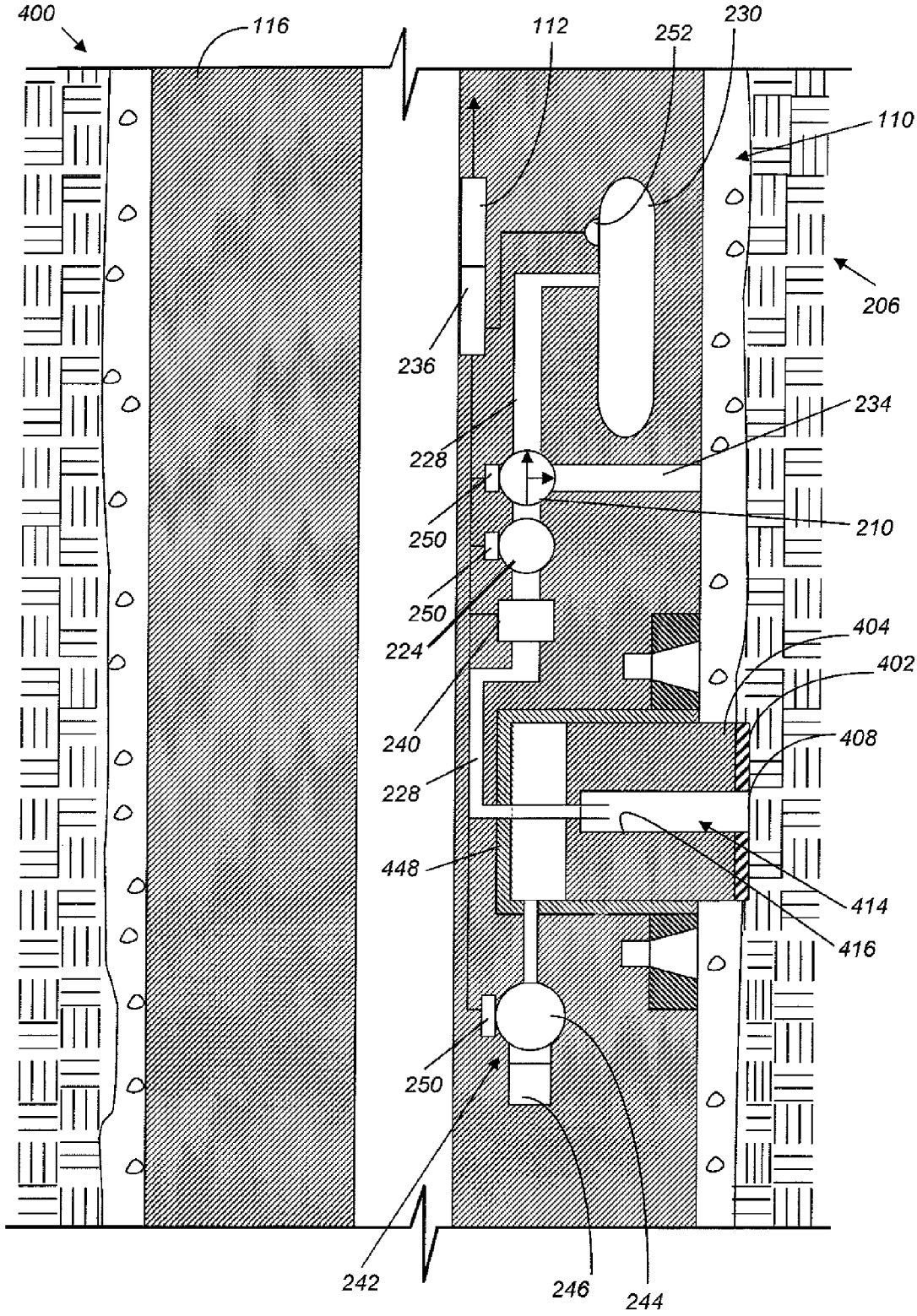
FIG. 4 illustrates another example of a down hole fluid sampling tool according to the disclosure.

FIG. 4 is another non-limiting embodiment of a downhole fluid sampling tool 400. In several embodiments, the fluid sampling tool 400 may include components substantially similar to the components as described above with respect to the tool 200 shown in FIG. 2. In the embodiment of FIG. 4, a sampling probe 404 has a durable rubber pad 402 at a distal end of the sampling probe 404. The pad 402 may be mechanically pressed against the borehole wall adjacent a formation 206 hard enough to form a hydraulic seal between the wall and probe 404. A probe extension and retraction device 242 may be used to extend and retract the sampling probe 404. Any number of extension and retraction devices 242 may be used and remain within the scope of the disclosure. In the non-limiting example shown in FIG. 4, the extension and retraction device 242 includes a hydraulic pump 244 that pumps hydraulic fluid contained in a reservoir 246 to and from a probe housing 448. The sampling probe 404 is movably disposed in the probe housing 448, such that hydraulic fluid pressure in the housing 448 causes the fluid sampling probe 404 to move in or out with respect to the tool 400.

The pad 402 includes an opening or port 408 leading to a cavity 414 formed by an inner wall 416 of the probe 404. A pump 224 may be used to reduce pressure within the cavity 414 to urge formation fluid into the port 408 and cavity 414. A flow line 228 may be used to convey fluid from the cavity 414 to the borehole annulus 110 via a dump line 234 or to a fluid sampling chamber 230. The dump line 234 may be routed to any suitable location as shown, above the sampling chamber 230 or in-line with the sampling chamber 230. A controllable valve 210 may be used to control fluid flow from the pump 224 to either the sampling chamber 230 or to the dump line 234. A fluid analysis device 240 may be used to determine type and content of fluid flowing in the flow line 228. The fluid analysis device 240 may include any number of testing devices, and is shown schematically here as a single box for simplicity. The fluid analysis device 240 may be located on either side of the pump 224 or the several test devices may be located on both the inlet and outlet of the pump 224 as desired. A more detailed description of the fluid analysis device 240 is described above with reference to FIG. 3.

The pump 224 may be controlled by one or more surface controllers (see 120 FIG. 1), or by one or more downhole controllers 236 as shown and by programmed instructions that are stored in a memory within the controller 236 and executed by a processor in the controller 236. Bi-directional communication between the surface and the tool 400 may be accomplished using a transceiver 112 in communication with the controller 120, 236. As mentioned above with reference to FIG. 1, the transceiver 112 may utilize any number of communication media, including drilling fluid pulse telemetry and wired telemetry. The tool may be disposed on a wired pipe or a wireline tool carrier may be used where a communication cable extends to the surface.

Addressable actuators 250 may be coupled to the pump 224 for receiving pump-specific communication from the controller 236. The controller may issue control commands such as on/off commands, pump rate commands and/or pump direction commands to control fluid flow within the tool 400. An addressable actuator 250 may be coupled to the probe extension pump 244 so that the controller 236 may be used to control probe extension as well. Any suitable addressable actuator may be used or an addressable circuit may be incorporated into the pumps for receiving pump-specific communication from the controller 120, 236. The controllable valve 210 may be actuated by a similar actuator 250 controlled by commands from the controller 236.

The several exemplary embodiments disclosed herein provide autonomous switchover from a clean-up process to a sampling process using the tool 400. In operation, commands from the controller 236 may initiate the pump 224 for a fluid clean-up process. The fluid clean-up process is an initial sampling to generate a flow rate in the chamber and flow line 228. Clean-up flow is through the controllable valve 210 to help remove borehole fluid that may be contaminating the fluid entering the tool from the formation 206. The fluid analysis device 240 uses several test devices for autonomous switchover from the clean-up process to the fluid sampling process. Once the fluid is relatively free of contamination by borehole fluid, the controller may actuate the controllable valve 210 to automatically switch flow from the dump line 234 to the line 228 leading to the sample chamber 230. Multiple tanks 230 may be used for repeat sampling, and second or other tanks may be filled automatically simultaneously with the first tank 230 or after the first tank 230 is filled. Generally, sample tanks 230 may also be nitrogen buffered for keeping the sample in single phase during retrieval from down hole to the surface.

The autonomous switchover and repeat sampling may be accomplished using a closed-loop sensor and actuator system. The fluid analysis device 240 takes multiple measurements as described above with reference to FIG. 3 to estimate several fluid characteristics of the fluid entering the probe 404. These estimates are transmitted as electrical signals to the controller 236 processor. In one example, the processor may be used to access information relating to characteristics of drilling fluid and/or borehole fluid, and these characteristics may be used in programs to compare fluid entering the probe to the drilling and/or borehole fluid characteristics. In another example, known formation fluid characteristics are stored in the database and used to compare the characteristics estimated using the fluid analysis device 240. The controller may be programmed with a preset acceptable level of contamination, such as 5% acceptable contamination for example. Once the preset acceptable contamination is achieved, the controller sends an electrical signal to the addressable pump actuators 250 and/or to the controllable valve 210. In response to the transmitted command, the pump rate the pump 224 and the valve 210 position are change to automatically begin a sample acquisition process. A pressure sensor 252 may be used to monitor fluid pressure in the sample tank 230. A suitable overpressure for maintaining the sampled fluid in single-phase may be programmed into the controller. A signal from the pressure sensor 252 may be conveyed to the controller 236, and the controller 236 may then process the received pressure signal and command the pump 224 to stop pumping fluid into the tank 230. The controller may then send a command signal to the addressable pump actuator 250 coupled to the probe extension pump 244 to retract the probe 404.

In the non-limiting example of FIG. 4, the sampling probe 404 is shown mounted on the sub 116, but any suitable mounting location may be used that allows formation fluid communication into the tool 400. For example, a sub member extending from the tool 400 may be used as a mounting location. In one example, the fluid sampling probe 404 may be incorporated into a centralizer. Those skilled in the art will understand that a centralizer is a member, usually metal, extending in a radial direction from the sub 116 and is used to help keep the sub 116 centered within the borehole. Other configurations of downhole tools may use ribs as centralizers or no centralizer at all. In some cases, a backup shoe may be used to provide a counter force to help keep the probe pad 402 pressed against the borehole wall.

The several embodiments described above and shown in FIGS. 1-4 provide for a closed-loop formation fluid sampling system having autonomous switchover from a clean-up process to a fluid sampling process. The closed-loop system further provides for optimized pump rates in order to provide maximum clean-up in the shortest possible time and then to switch over, autonomously, to begin filling sampling tanks. In this manner, tasks traditionally performed by an application engineer, may be enhanced or transferred completely to the autonomous process. Real-time monitoring in conjunction with the closed-loop process further provides autonomous control of the pump-rates to help ensure fluid pressures are maintained above the fluid bubble-point or wax/asphaltene fall out pressure during draw down and sampling. The real-time comparison of sampled fluid to known drilling fluid characteristics and/or the real-time comparison of sampled fluid to known formation fluid characteristics provide determination and verification of a reachable residual contamination level that may be acceptable for useful formation fluid samples.

Figure 5:
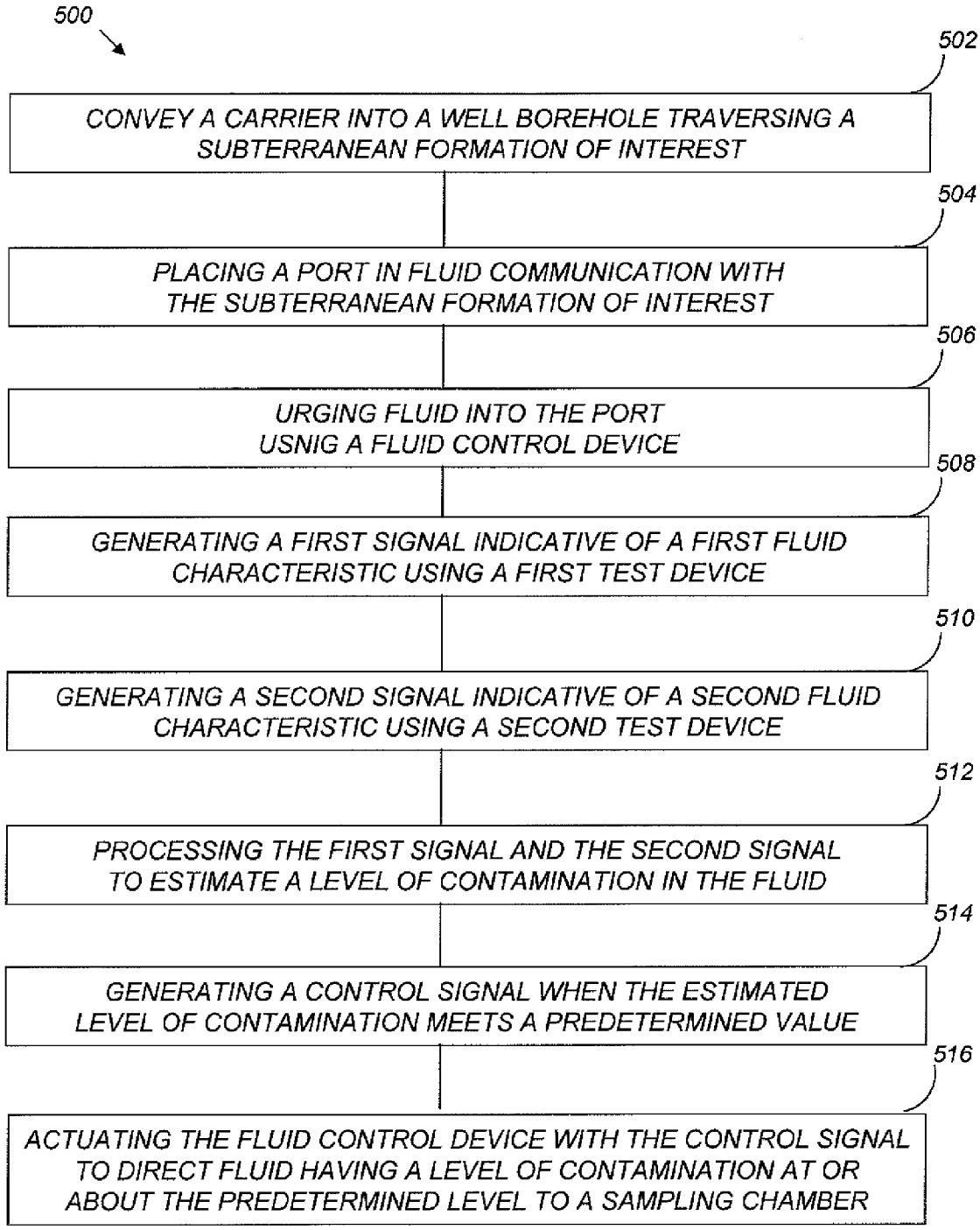
FIG. 5 illustrates a method for formation fluid sampling according to the disclosure.

FIG. 5 illustrates a method 500 for fluid sampling and acquisition that includes a clean-up process by which contaminants, usually borehole fluids, are removed from the fluid sample stream flowing into a fluid sampling tool. The exemplary method 500 includes conveying a carrier into a well borehole that traverses a subterranean formation of interest 502. The carrier has a port and the method includes placing the port in fluid communication with the subterranean formation of interest 504. The method includes urging a fluid into the port using a fluid control device 506, the fluid containing a formation fluid and a contaminant. A first signal indicative of a first fluid characteristic of the fluid is generated using a first test device in communication with the fluid 508, and a second signal indicative of a second fluid characteristic of the fluid is generated using a second test device in communication with the fluid 510. The first signal and the second signal are processed 512 using a processing device to estimate a level of contamination in the fluid, and a control signal is generated 514 when the estimated level of contamination meets a predetermined value, the control signal actuating 516 the fluid control device to direct fluid having a level of contamination at about or below the predetermined value to a fluid sampling chamber carried by the carrier.

In one embodiment, at least one of the first signal and the second signal is indicative of an optical characteristic of fluid in the fluid cell, and the optical characteristic comprises one or more of fluorescence, a reflectance and spectral energy. In one embodiment, at least one of the first signal and the second signal is indicative of an electrical characteristic of fluid in the fluid cell, and the electrical characteristic comprises one or more of resistivity, capacitance, and dielectric constant. In another embodiment, at least one of the first signal and the second signal is indicative of a physical characteristic of fluid in the fluid cell, and the physical characteristic comprises one or more of viscosity, pressure, temperature, fluid density, and acoustic transmittance. The method of generating the first signal and the second signal may be a combination of at least two of an optical characteristic, and electrical characteristic and a physical characteristic of fluid in the fluid cell.

In several embodiments, the method may include sending control instructions from the processing device to one or more addressable pumps and/or to one or more addressable valves for controlling fluid flow in the tool.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Such insubstantial variations are to be considered within the scope of the claims below.

What is claimed is:

1. A downhole apparatus comprising:

a carrier conveyable in a well borehole;

a pump providing a variable pump rate for generating a pressure gradient across a flow path of a fluid;

a fluid control device that urges the fluid into a port, the fluid containing a contaminant;

a first test device in communication with the fluid, the first test device generating a first signal indicative of a first fluid characteristic;

a second test device in communication with the fluid, the second test device generating a second signal indicative of a second fluid characteristic; and a processing device that receives the first signal and the second signal, the processing device processing the first signal and the second signal to estimate a level of contamination in the fluid, the processing device generating a control signal when the estimated level of contamination meets a predetermined value.

2. A method for estimating fluid contamination downhole comprising:

conveying a carrier in a well borehole;

adjusting a variable pump rate to reduce a contaminant disposed in a fluid;

urging the fluid into a port using a fluid control device, the fluid containing a contaminant;

generating a first signal indicative of a first fluid characteristic using a first test device in communication with the fluid;

generating a second signal indicative of a second fluid characteristic using a second test device in communication with the fluid;

processing the first signal and the second signal using a processing device to estimate a level of contamination in the fluid; and generating a control signal when the estimated level of contamination meets a predetermined value.

3. A downhole apparatus comprising:

a carrier conveyable in a well borehole;

a pump providing a variable pump rate for generating a pressure gradient across a flow path of a fluid;

a fluid control device that urges the fluid into a port, the fluid containing a contaminant;

a test device in communication with the fluid, the test device generating a signal indicative of a fluid characteristic;

a processing device that receives the signal, the processing device processing the signal to estimate a level of contamination in the fluid, the processing device generating a control signal when the estimated level of contamination meets a predetermined value.

4. An apparatus according to claim 3, wherein the test device includes a device for estimating an optical characteristic of the fluid.

5. An apparatus according to claim 3, wherein the test device comprises one or more of a fluorescence test device, a reflectometer and a spectrometer.

6. An apparatus according to claim 3, wherein the test device includes a device for estimating an electrical characteristic of the fluid.

7. An apparatus according to claim 6, wherein the device for estimating an electrical characteristic comprises one or more of a resistivity test device, a capacitance test device, and a dielectric test device.

8. An apparatus according to claim 3, wherein the test device includes a device for estimating a physical characteristic of the fluid.

9. An apparatus according to claim 3, wherein the test device comprises one or more of a viscometer, a pressure transducer, a temperature transducer, a fluid density test device, and a sonic test device.

10. An apparatus according to claim 3, wherein the test device comprises one or more of a chemical test device, a fluid compositional analysis device, a gas chromatograph, a pH test device, a salinity test device, a $CO_2$ test device, an $H_2S$ test device, a device for determining wax and asphaltene components, a device for determining metal content, and a device for determining acidity of the fluid.

11. An apparatus according to claim 3, wherein the test device includes a plurality of devices for estimating a combination of at least two of an optical characteristic, an electrical characteristic, a physical characteristic and a chemical characteristic of the fluid.

12. An apparatus according to claim 3, wherein the fluid control device includes one or more addressable pumps that receive control instructions from the processing device.

13. An apparatus according to claim 3, wherein the fluid control device includes one or more addressable valves that receive control instructions from the processing device.

14. An apparatus according to claim 3, wherein the apparatus comprises a fluid sampling device.

15. An apparatus according to claim 3, wherein the control signal actuates the fluid control device to direct fluid having a level of contamination at about or below the predetermined value to a fluid sampling chamber carried by the carrier.

16. An apparatus according to claim 3 further comprising at least another pump.

17. An apparatus according to claim 3, wherein the pump rate is adjusted for a clean-up process.

18. An apparatus according to claim 3, wherein the pump generates a flow in a sleeve surrounding a cavity.

19. An apparatus according to claim 3, wherein the pressure gradient comprises a vector of a varying direction and a varying magnitude.

20. A method for estimating fluid contamination downhole comprising:

conveying a carrier in a well borehole;

adjusting a variable pump rate to reduce a contaminant disposed in a fluid;

urging the fluid into a port using a fluid control device, the fluid containing a contaminant;

generating a signal indicative of a fluid characteristic using a test device in communication with the fluid;

processing the signal using a processing device to estimate a level of contamination in the fluid; and generating a control signal when the estimated level of contamination meets a predetermined value.

21. A method according to claim 20, wherein the signal is indicative of an optical characteristic of the fluid.

22. A method according to claim 21, wherein the optical characteristic comprises one or more of fluorescence, a reflectance and spectral energy.

23. A method according to claim 20, wherein the signal is indicative of an electrical characteristic of the fluid.

24. A method according to claim 23, wherein the electrical characteristic comprises one or more of resistivity, capacitance, and dielectric constant.

25. A method according to claim 20, wherein the signal is indicative of a physical characteristic of the fluid.

26. A method according to claim 25, wherein the physical characteristic comprises one or more of viscosity, pressure, temperature, fluid density, and acoustic transmittance.

27. A method according to claim 20, wherein generating the signal includes generating one or more signals indicative of a combination of at least two of an optical characteristic, an electrical characteristic, a chemical characteristic and a physical characteristic of the fluid.

28. A method according to claim 20, wherein the fluid control device includes one or more addressable pumps, the method including sending control instructions from the processing device to the one or more addressable pumps.

29. A method according to claim 20, wherein the fluid control device includes one or more addressable valves, the method including sending control instructions from the processing device to the one or more addressable valves.

30. A method according to claim 20 further comprising sampling the fluid using a fluid sampling device.

31. A method according to claim 20 further comprising actuating the fluid control device using the control signal; and using the fluid control device to direct fluid having a level of contamination at about or below the predetermined value to a fluid sampling chamber carried by the carrier.

32. A method according to claim 20, wherein adjusting comprises generating a pressure gradient across a flow path of the fluid.

* * * * *